US012262787B2

(12) United States Patent
Jones et al.

(10) Patent No.: US 12,262,787 B2
(45) **Date of Patent: *Apr. 1, 2025**

(54) SOLE STRUCTURE FOR AN ARTICLE OF FOOTWEAR

(71) Applicant: NIKE, Inc., Beaverton, OR (US)

(72) Inventors: Michael Jones, Beaverton, OR (US); Michael F. Joubert, Sammamish, WA (US); Chun-Wei Kuo, Portland, OR (US); Yong S. Lee, Portland, OR (US); Thea Moshofsky, Beaverton, OR (US); Randall S. Wolfe, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/399,232

(22) Filed: Dec. 28, 2023

(65) Prior Publication Data

US 2024/0138519 A1 May 2, 2024

Related U.S. Application Data

(63) Continuation of application No. 17/703,584, filed on Mar. 24, 2022, now Pat. No. 11,889,892, which is a (Continued)

(51) Int. Cl.
*A43B 13/18* (2006.01)
*A43B 13/40* (2006.01)

(52) U.S. Cl.
CPC ..... *A43B 13/40* (2013.01); *A43B 13/186* (2013.01); *A43B 13/188* (2013.01)

(58) Field of Classification Search
CPC ..... A43B 13/18; A43B 13/186; A43B 13/188
(Continued)

(56) References Cited

U.S. PATENT DOCUMENTS 4,364,188 A 12/1982 Turner et al.
4,557,060 A 12/1985 Kawashima
(Continued)

FOREIGN PATENT DOCUMENTS

CA 2014256 A1 10/1991
CN 103005781 A 4/2013
(Continued)

OTHER PUBLICATIONS

European Patent Office (ISA), International Search Report and Written Opinion for PCT App. No. PCT/US2020/052357, mailed Nov. 27, 2020.

(Continued)

*Primary Examiner* — Marie D Bays
(74) *Attorney, Agent, or Firm* — Honigman LLP; Matthew H. Szalach; Jonathan P. O'Brien

(57) ABSTRACT

A sole structure for an article of footwear includes a midsole having a top surface, a bottom surface opposite the top surface, and a peripheral surface extending between the top surface and the bottom surface. The bottom surface includes a recess defining a first opening in the peripheral surface. The sole structure for an article of footwear also includes an insert disposed within the recess and including a first material having a first gloss unit value and a second material disposed on an outer surface of the first material and having a second gloss unit value. The second material is at least partially disposed within the first opening.

20 Claims, 7 Drawing Sheets

Related U.S. Application Data continuation of application No. 16/581,840, filed on Sep. 25, 2019, now Pat. No. 11,291,271.

(58) Field of Classification Search
USPC ..... 36/28, 103, 31
See application file for complete search history.

(56) References Cited

U.S. PATENT DOCUMENTS

| | | | | |
|---|---|---|---|---|
| 4,561,195 | A | 12/1985 | Onoda et al. | |
| 4,667,423 | A | 5/1987 | Autry et al. | |
| 5,092,060 | A | 3/1992 | Franchey | |
| 5,155,927 | A | 10/1992 | Bates et al. | |
| 5,220,737 | A | 6/1993 | Edington | |
| 5,363,570 | A | 11/1994 | Allen et al. | |
| 5,575,088 | A | 11/1996 | Allen et al. | |
| 5,704,137 | A | 1/1998 | Dean et al. | |
| 5,718,063 | A | 2/1998 | Yamashita et al. | |
| 5,930,918 | A | 8/1999 | Healy et al. | |
| 6,038,790 | A | 3/2000 | Pyle et al. | |
| 6,119,371 | A | 9/2000 | Goodwin et al. | |
| 6,158,149 | A | 12/2000 | Rudy | |
| 6,691,432 | B2 | 2/2004 | Masseron | |
| 6,883,253 | B2 | 4/2005 | Smith et al. | |
| 7,000,334 | B2 | 2/2006 | Gillespie | |
| 7,000,335 | B2 | 2/2006 | Swigart et al. | |
| 7,200,955 | B2 | 4/2007 | Foxen | |
| 7,426,792 | B2 | 9/2008 | Swigart et al. | |
| 7,444,767 | B2 | 11/2008 | Kilgore et al. | |
| 7,707,745 | B2 | 5/2010 | Schindler et al. | |
| 8,042,286 | B2 | 10/2011 | Schindler et al. | |
| 8,196,316 | B2 | 6/2012 | Cook et al. | |
| 9,009,991 | B2 | 4/2015 | Sills | |
| 11,291,271 | B2 * | 4/2022 | Jones | A43B 13/188 |
| 11,889,892 | B2 * | 2/2024 | Jones | A43B 1/0072 |
| 2002/0092202 | A1 | 7/2002 | Masseron | |
| 2002/0121031 | A1 | 9/2002 | Smith et al. | |
| 2004/0045192 | A1 | 3/2004 | Lin | |
| 2005/0160626 | A1 | 7/2005 | Townsend | |
| 2005/0167029 | A1 | 8/2005 | Rapaport et al. | |
| 2006/0179683 | A1 | 8/2006 | Weiss et al. | |
| 2006/0283046 | A1 | 12/2006 | Mason | |
| 2008/0034614 | A1 | 2/2008 | Fox et al. | |
| 2008/0295361 | A1 | 12/2008 | Johnson et al. | |
| 2009/0178300 | A1 | 7/2009 | Parker | |
| 2010/0122471 | A1 | 5/2010 | Edington et al. | |
| 2011/0131831 | A1 | 6/2011 | Peyton et al. | |
| 2012/0052249 | A1 | 3/2012 | Turner | |
| 2012/0144695 | A1 | 6/2012 | McDowell et al. | |
| 2012/0233877 | A1 | 9/2012 | Swigart | |
| 2013/0160324 | A1 | 6/2013 | Peyton et al. | |
| 2014/0075778 | A1 | 3/2014 | Bruce et al. | |
| 2014/0259749 | A1 | 9/2014 | Taylor | |
| 2020/0305549 | A1 | 10/2020 | Bailly et al. | |

FOREIGN PATENT DOCUMENTS

| | | | |
|---|---|---|---|
| CN | 108366638 | A | 8/2018 |
| EP | 3280284 | A1 | 2/2018 |
| FR | 2553636 | A1 | 4/1985 |
| KR | 100807642 | B1 | 2/2008 |

OTHER PUBLICATIONS

USPTO, Non-Final Office Action for U.S. Appl. No. 17/703,584, mailed Jun. 15, 2023.

China National Intellectual Property Administration, Office Action for CN App. No. 20208006778.3, mailed May 16, 2024.

* cited by examiner

SOLE STRUCTURE FOR AN ARTICLE OF FOOTWEAR

CROSS-REFERENCE TO RELATED APPLICATION

This application is a continuation of U.S. patent application Ser. No. 17/703,584, filed Mar. 24, 2022, which is a continuation of U.S. patent application Ser. No. 16/581,840, filed Sep. 25, 2019, the disclosures of which are hereby incorporated by reference in their entireties.

FIELD

The present disclosure relates generally to a sole structure for an article of footwear, and more particularly to a sole structure comprising a midsole having an insert received therein.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate an insert (e.g., a fluid-filled bladder or a foam insert) to increase the durability of the sole structure, as well as to provide cushioning to the foot by compressing resiliently under an applied load to attenuate ground-reaction forces. Sole structures may also include a comfort-enhancing insole or sockliner located within a void proximate to the bottom portion of the upper and a strobel attached to the upper and disposed between the midsole and the insole or sockliner.

Midsoles employing inserts typically include a recess sized and shaped to receive a similarly sized and shaped insert. The inserts are often constructed from a foam material that both flexes and provides support when compressed resiliently under applied loads, such as during athletic movements. In this regard, inserts are often designed to balance support for the foot with cushioning characteristics that provide responsiveness as the insert resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
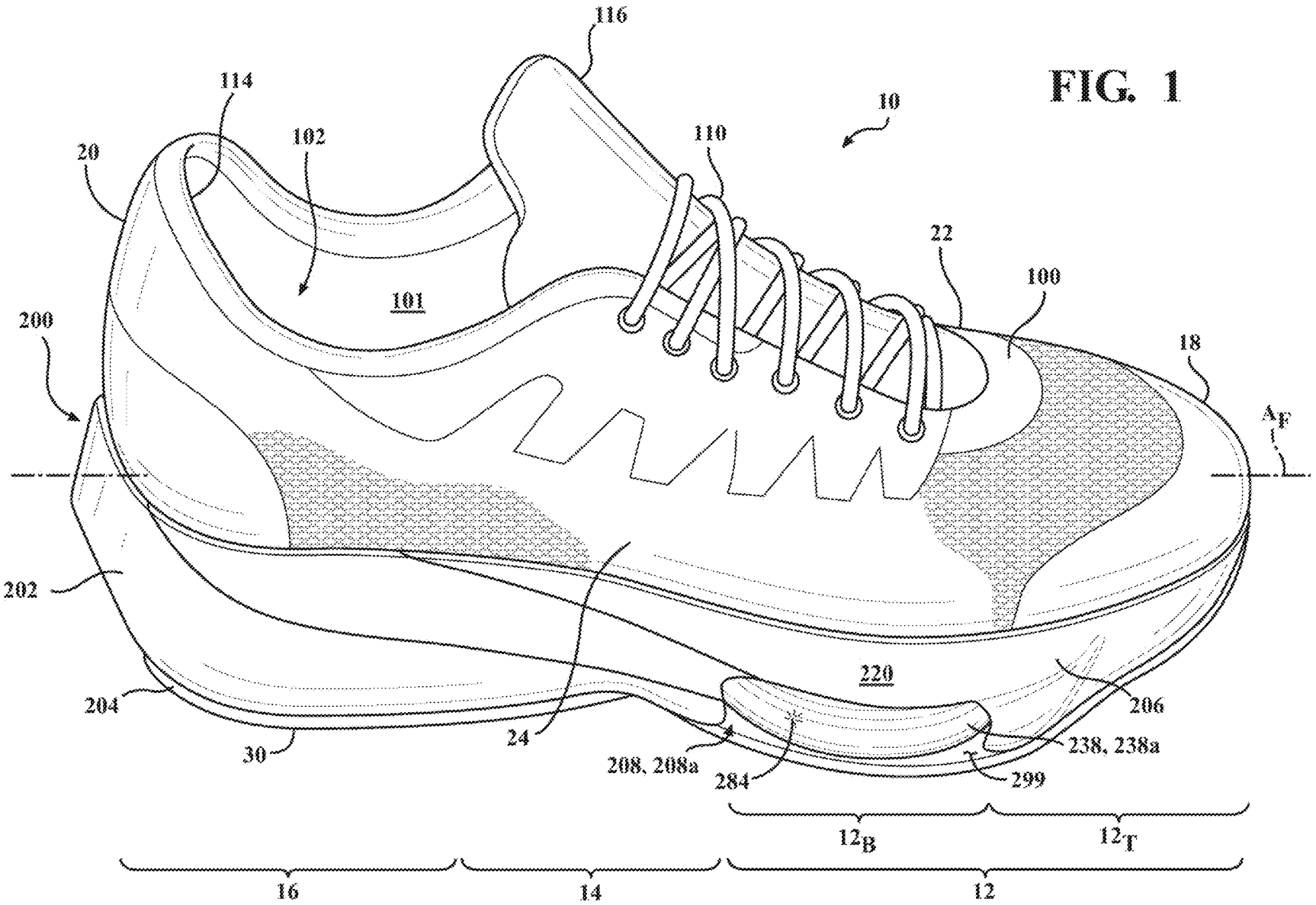
FIG. 1 is a side elevation view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure includes a midsole having a top surface, a bottom surface opposite the top surface, and a peripheral surface extending between the top surface and the bottom surface. The bottom surface includes a recess defining a first opening in the peripheral surface. The sole structure also includes an insert disposed within the recess and including a first material having a first gloss unit value and a second material disposed on an outer surface of the first material and having a second gloss unit value. The second material is at least partially disposed within the first opening.

Implementations of the disclosure may include one or more of the following optional features. In some implementations, the first material is visible through the second material. The first opening may be disposed in a medial side of the midsole. The recess may define a second opening in the peripheral surface and the second material may be at least partially disposed within the second opening. Here, the first opening may be disposed in a medial side of the midsole and the second opening may be disposed in a lateral side of the midsole opposite the medial side.

In some examples, the sole structure includes an outsole coupled to at least one of the midsole or the insert and defines an aperture, the second material at least partially disposed within the aperture. Here, the insert may include a protrusion disposed within the aperture. Optionally, the second material may be disposed on the protrusion.

In some configurations, the insert includes a central member and a peripheral member, the peripheral member at least partially disposed within the first opening. Here, the second material is disposed on the peripheral member. In some examples, the second gloss unit value is greater than the first gloss unit value.

Another aspect of the disclosure provides a sole structure for an article of footwear. The sole structure includes a midsole having a top surface, a bottom surface opposite the top surface, and a peripheral surface extending between the top surface and the bottom surface. The midsole includes a recess (i) disposed between the top surface and the bottom surface and (ii) defines a first opening in the peripheral surface. The sole structure also includes an insert disposed within the recess and including a first material having a first gloss unit value and a second material disposed on an outer surface of the first material and having a second gloss unit value. The second material is at least partially disposed within the first opening.

Implementations of this aspect of the disclosure may include one or more of the following optional features. In some configurations, the first material is visible through the second material. The first opening may be disposed in a medial side of the midsole. The recess may define a second opening in the peripheral surface, the second material being at least partially disposed within the second opening. Here, the first opening may be disposed in a medial side of the midsole and the second opening may be disposed in a lateral side of the midsole opposite the medial side.

In some implementations, an outsole is coupled to at least one of the midsole or the insert and defines an aperture, the second material at least partially disposed within the aperture. Here, the insert may include a protrusion disposed within the aperture. The second material may be disposed on the protrusion.

In some examples, the insert includes a central member and a peripheral member, the peripheral member at least partially disposed within the first opening. Here, the second material may be disposed on the peripheral member. In other examples, the second gloss unit value is greater than the first gloss unit value.

The details of one or more implementations of the disclosure are set forth in the accompanying drawings and the description below. Other aspects, features, and advantages will be apparent from the description and drawings, and from the claims.

Referring to FIG. 1, an article of footwear 10 includes an upper 100 and a sole structure 200. The article of footwear 10 may be divided into one or more regions. The regions may include a forefoot region 12, a mid-foot region 14, and a heel region 16. The forefoot region 12 may be subdivided into a toe portion $\mathbf{12}_T$ corresponding with phalanges, and a ball portion $\mathbf{12}_B$ associated with metatarsal bones of a foot. The mid-foot region 14 may correspond with an arch area of the foot, and the heel region 16 may correspond with rear portions of the foot, including a calcaneus bone.

The footwear 10 may further include an anterior end 18 associated with a forward-most point of the forefoot region 12, and a posterior end 20 corresponding to a rearward-most point of the heel region 16. A longitudinal axis $A_F$ of the footwear 10 extends along a length of the footwear 10 from the anterior end 18 to the posterior end 20, parallel to a ground surface. The longitudinal axis $A_F$ may be centrally located along the length of the footwear 10, such that the longitudinal axis $A_F$ generally divides the footwear 10 into a medial side 22 and a lateral side 24. Accordingly, the medial side 22 and the lateral side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the medial side 22 to the lateral side 24.

Figure 2:
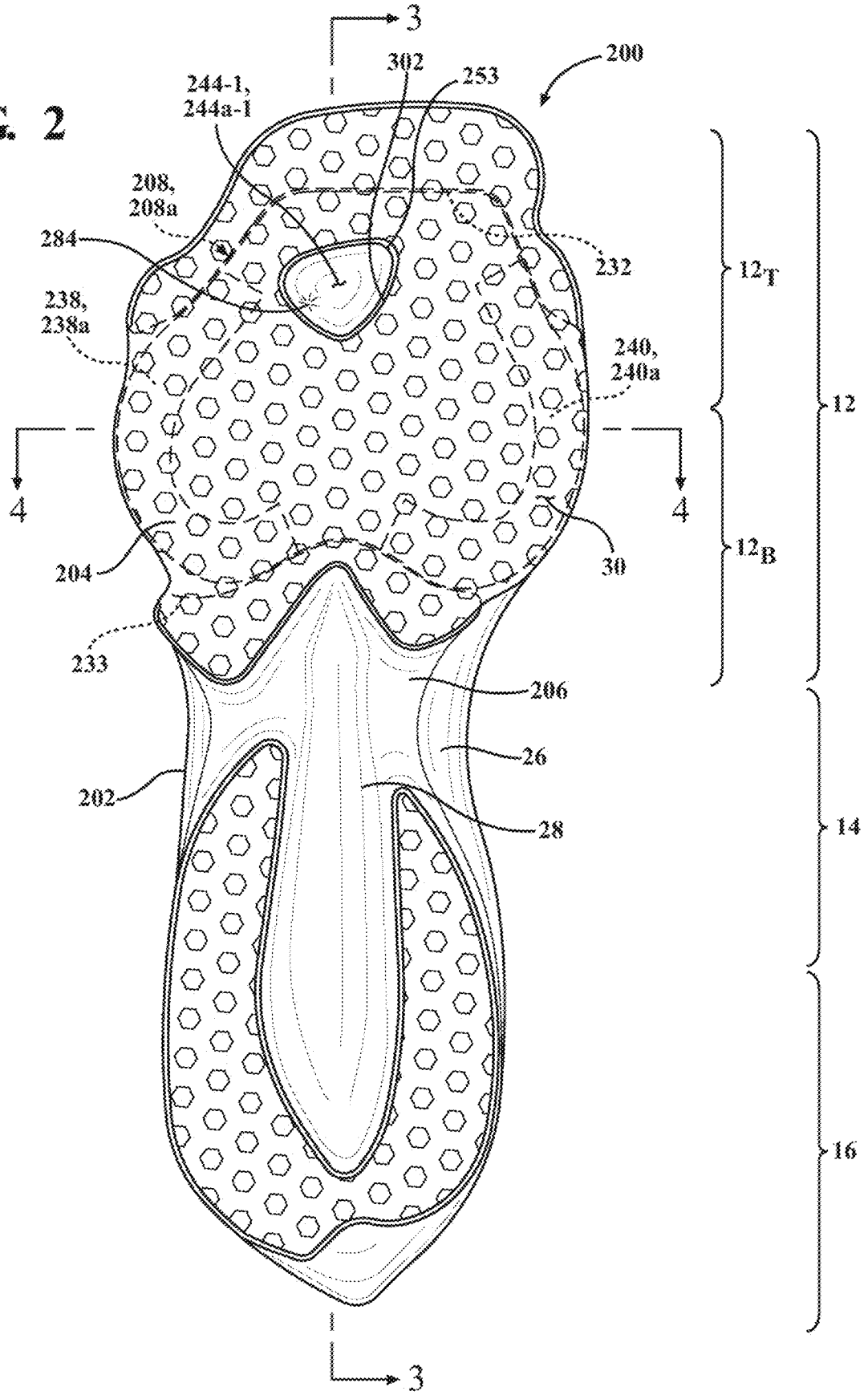
FIG. 2 is bottom plan view of a sole structure of the article of footwear of FIG. 1.

The article of footwear 10, and more particularly, the sole structure 200, may be further described as including a peripheral region 26 and an interior region 28, as illustrated in FIG. 2. The peripheral region 26 is generally described as being a region between the interior region 28 and an outer perimeter of the sole structure 200. Particularly, the peripheral region 26 extends from the forefoot region 12 to the heel region 16 along each of the medial side 22 and the lateral side 24, and wraps around each of the forefoot region 12 and the heel region 16. The interior region 28 is circumscribed by the peripheral region 26, and extends from the forefoot region 12 to the heel region 16 along a central portion of the sole structure 200. Accordingly, each of the forefoot region 12, the mid-foot region 14, and the heel region 16 may be described as including the peripheral region 26 and the interior region 28.

The upper 100 includes interior surfaces 101 that define an interior void 102 configured to receive and secure a foot for support on the sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

Figure 3:
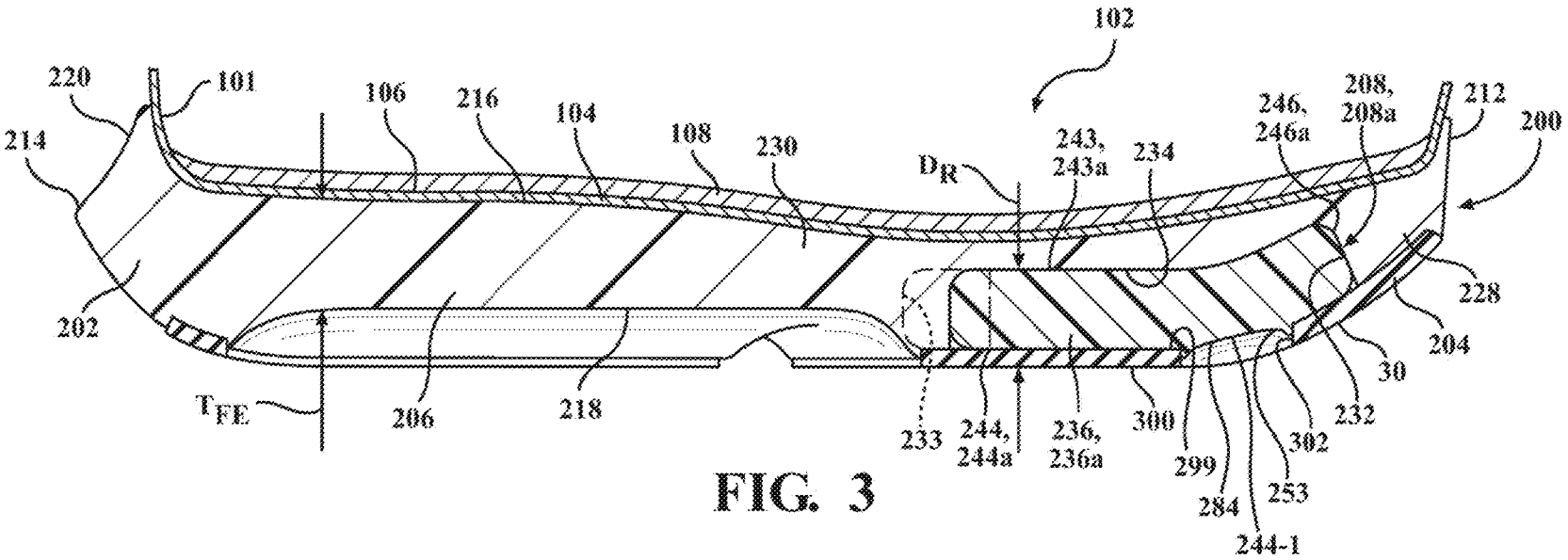
FIG. 3 is a cross-sectional view of the sole structure of FIG. 2, taken along line 3-3 of FIG. 2 corresponding to a longitudinal axis of the sole structure.
Figure 4:
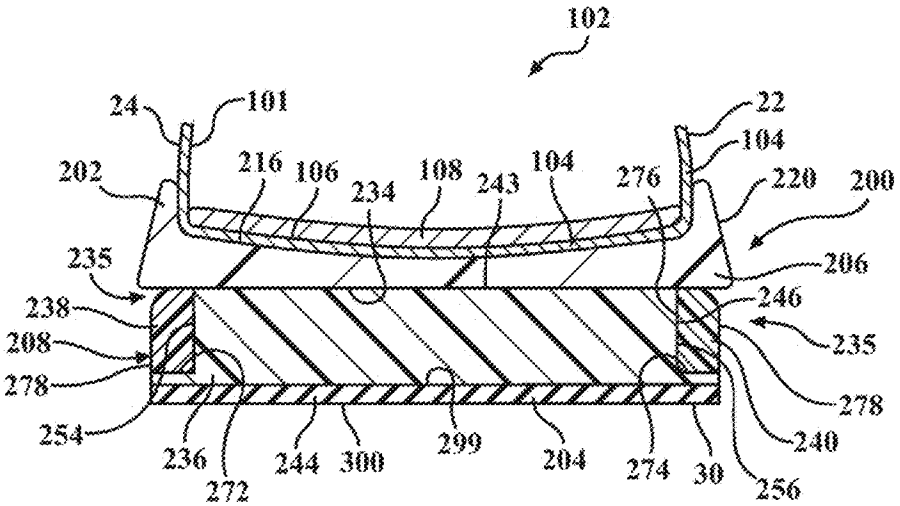
FIG. 4 is a cross-sectional view of the sole structure of FIG. 2, taken along line 4-4 of FIG. 2 and corresponding to a lateral axis of the sole structure.

With reference to FIGS. 3 and 4, in some examples, the upper 100 includes a strobel 104 having a bottom surface opposing the sole structure 200 and an opposing top surface defining a footbed 106 of the interior void 102. Stitching or adhesives may secure the strobel to the upper 100. The footbed 106 may be contoured to conform to a profile of the bottom surface (e.g., plantar) of the foot. Optionally, the upper 100 may also incorporate additional layers such as an insole 108 or sockliner that may be disposed upon the strobel 104. The insole or sockliner 108 may reside within the interior void 102 of the upper 100 and be positioned to receive a plantar surface of the foot to enhance the comfort of the article of footwear 10. Referring again to FIG. 1, an ankle opening 114 in the heel region 16 may provide access to the interior void 102. For example, the ankle opening 114 may receive a foot to secure the foot within the void 102 and to facilitate entry and removal of the foot from and to the interior void 102.

In some examples, one or more fasteners 110 extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 116 that extends between the interior void 102 and the fasteners 110.

With reference to FIGS. 1-4, the sole structure 200 includes a midsole 202 configured to provide cushioning characteristics to the sole structure 200, and one or more outsole members 204 configured to provide a ground-engaging surface 30 of the article of footwear 10. As illustrated in FIGS. 3 and 4, the midsole 202 may include a plurality of subcomponents for providing zonal cushioning and performance characteristics. For example, the midsole 202 may include a primary member 206 and a secondary member or insert 208. The subcomponents 206, 208 of the midsole 202 may be assembled and secured to each other using various methods of bonding, including adhesively bonding and melding, for example. As described in greater detail below, the outsole 204 may be overmolded onto the subcomponents 206, 208 of the midsole 202, such that the midsole 202 defines a profile of the ground-engaging surface 30 of the footwear 10.

Figure 5:
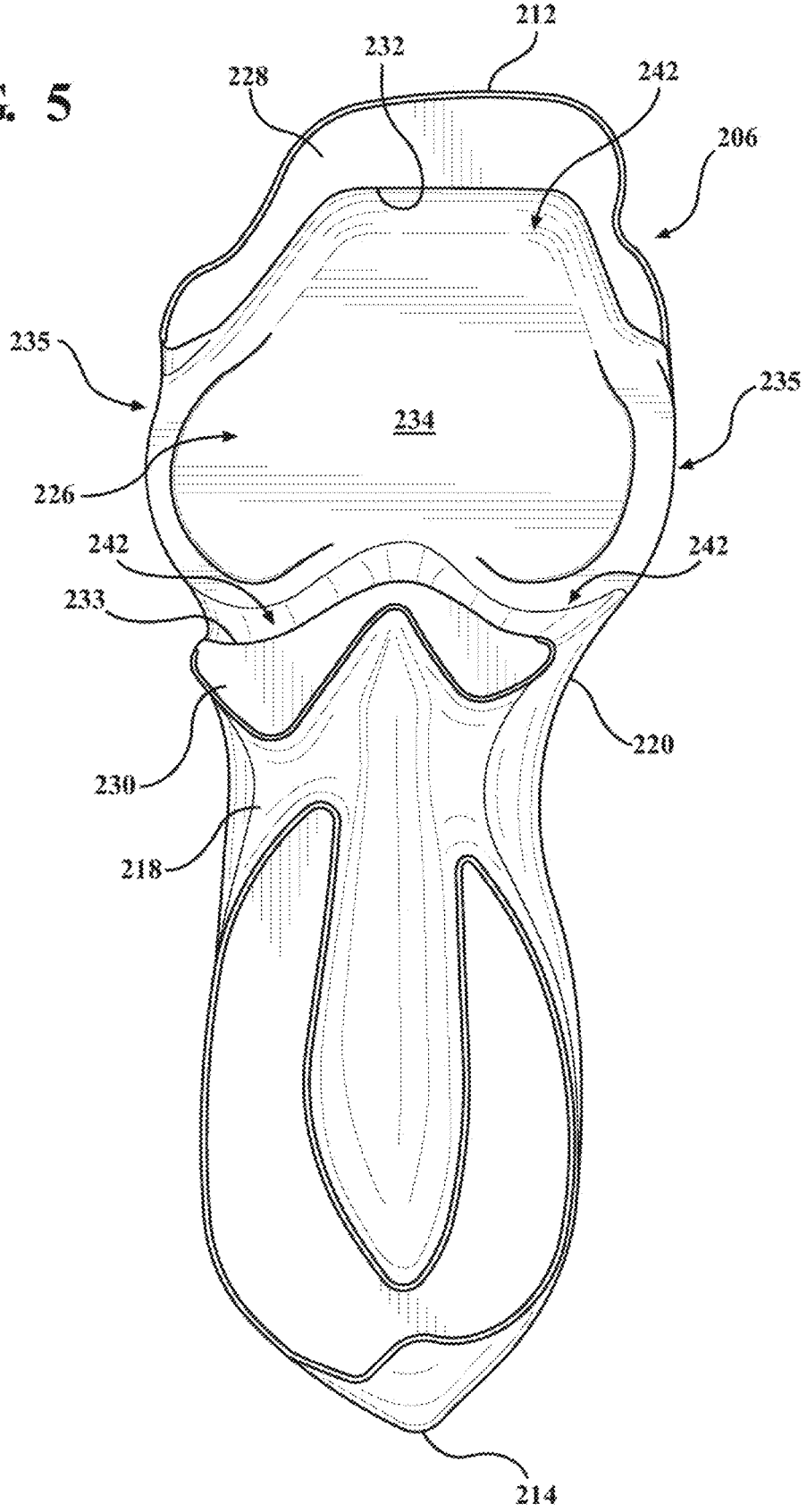
FIG. 5 is a bottom plan view of a midsole of the article of footwear of FIG. 1.

With reference to FIG. 5, the primary member 206 extends from a first end 212 at the anterior end 18 of the footwear 10 to a second end 214 at the posterior end 20 of the footwear. Accordingly, the primary member 206 may extend along an entire length of the footwear 10. As illustrated in FIGS. 3 and 4, the primary member 206 may further include a top surface 216 and a bottom surface 218 formed on an opposite side of the primary member 206 than the top surface 216. The top surface 216 of the primary member 206 is configured to oppose the strobel 104 of the upper 100, and may be contoured to define a profile of the footbed 106 corresponding to a shape of the foot. As shown in FIG. 3, a distance between the top surface 216 and the bottom surface 218 defines a thickness $T_{FE}$ of the primary member 206, which may vary along the length of the sole structure 200.

As illustrated in FIG. 1, the primary member 206 further includes a peripheral side surface 220 extending between the top surface 216 and the bottom surface 218. The peripheral side surface 220 generally defines an outer periphery of the sole structure 200.

With reference to FIG. 5, the primary member 206 may include a recess 226 sized and shaped to receive the insert 208. The recess 226 may be formed in the forefoot region 12 of the sole structure 200 and may be defined by an anterior peripheral sidewall 232 and a posterior peripheral sidewall 233. The anterior and posterior peripheral sidewalls 232, 233 may extend from the bottom surface 218 of the primary member 206 towards the top surface 216. Generally, the recess 226 separates the primary member 206 into an anterior segment 228 and a posterior segment 230. The anterior segment 228 extends between the recess 226 and the anterior end 18 of the sole structure 200, while the posterior segment 230 extends between the recess 226 and the posterior end 20 of the sole structure 200. In this regard, the anterior peripheral sidewall 232 may be disposed at a posterior end of the anterior segment 228, while the posterior peripheral sidewall 233 may be disposed at an anterior end of the posterior segment 230, such that the anterior peripheral sidewall 232 generally opposes or faces the posterior peripheral sidewall 233. As illustrated in FIG. 5, in some implementations, the anterior peripheral sidewall 232 defines a concave "U" shape, while the posterior peripheral sidewall 233 defines a convex "U" shape. It will be appreciated, however, that the anterior and posterior peripheral sidewalls 232, 233 may define other shapes (e.g., arcuate, sinusoidal, zig-zag, etc.) within the scope of the present disclosure.

In the illustrated example, the anterior and posterior peripheral sidewalls 232, 233 of the recess 226 extend partially from the bottom surface 218 to the top surface 216 and terminate at an intermediate surface 234 disposed between the bottom surface 218 and the top surface 216. Thus, as illustrated in FIG. 3, a depth $D_R$ of the recess 226, measured from the bottom surface 218 to the intermediate surface 234, extends only partially through the thickness $T_{FE}$ of the primary member 206. Here, the anterior segment 228 and the posterior segment 230 of the primary member 206 are connected to each other by the portion of the primary member 206 formed between the intermediate surface 234 and the top surface 216. Accordingly, the primary member 206 may be formed as a unitary structure extending from the forefoot region 12 to the heel region 16.

As illustrated in FIG. 3, in some examples, the anterior and posterior peripheral sidewalls 232, 233 intersect with the peripheral side surface 220 of the primary member 206 to define an opening 235 into the recess 226 through the peripheral side surface 220 of the primary member 206. Referring to FIG. 5, in some examples, the recess 226 defines one or more receptacles 242 for receiving the insert 208. As shown, a profile of each of the receptacles 242 may be defined by the anterior and posterior peripheral sidewalls 232, 233 of the recess 226 and may correspond to an outer peripheral profile of the insert 208. In this regard, the intermediate surface 234 and the anterior and posterior peripheral sidewalls 232, 233 may engage the insert 208, such that each receptacle 242 is substantially filled by the insert 208.

Figure 6:
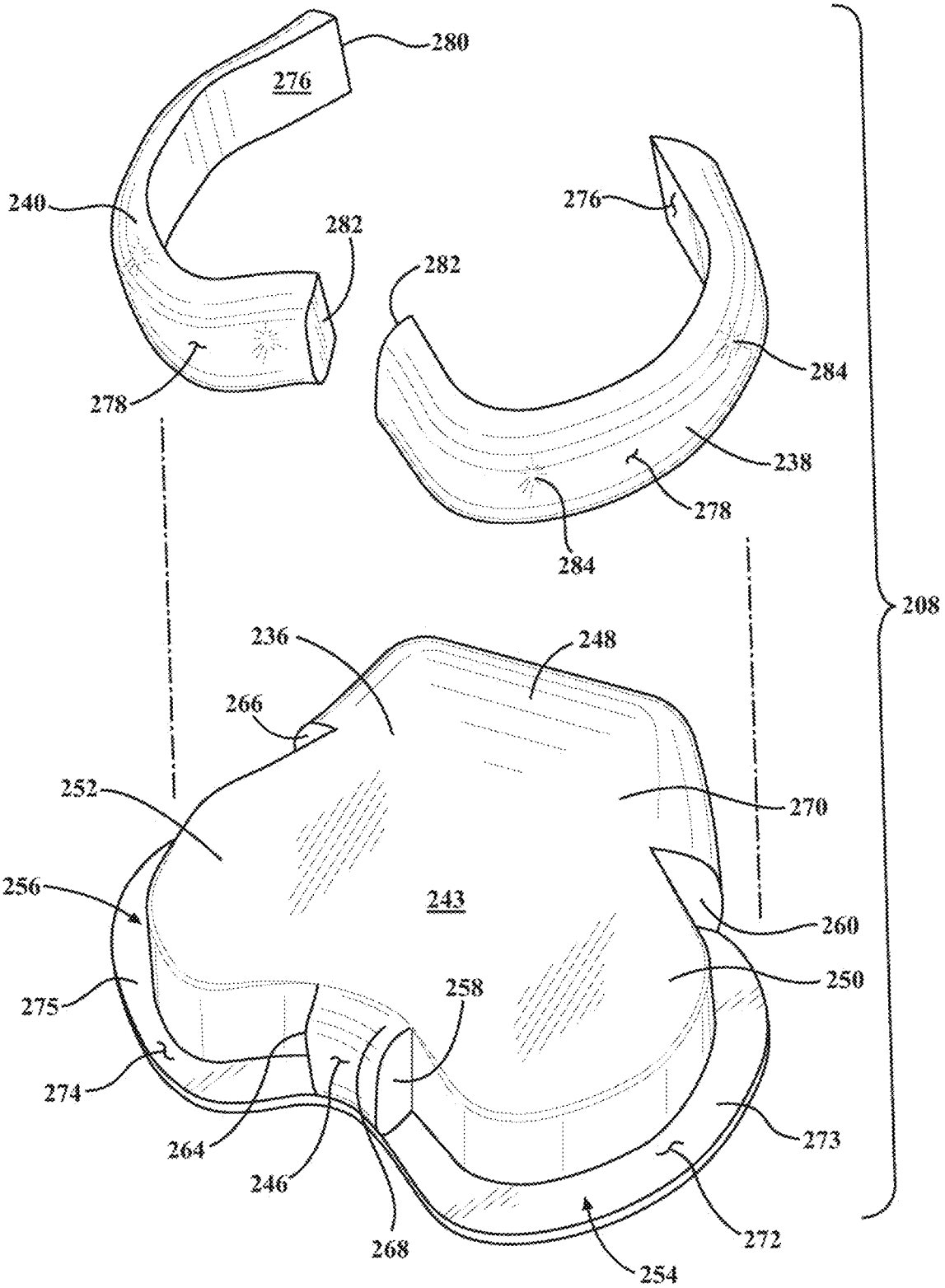
FIG. 6 is an exploded top perspective view of an insert of the article of footwear of FIG. 1.
Figure 7:
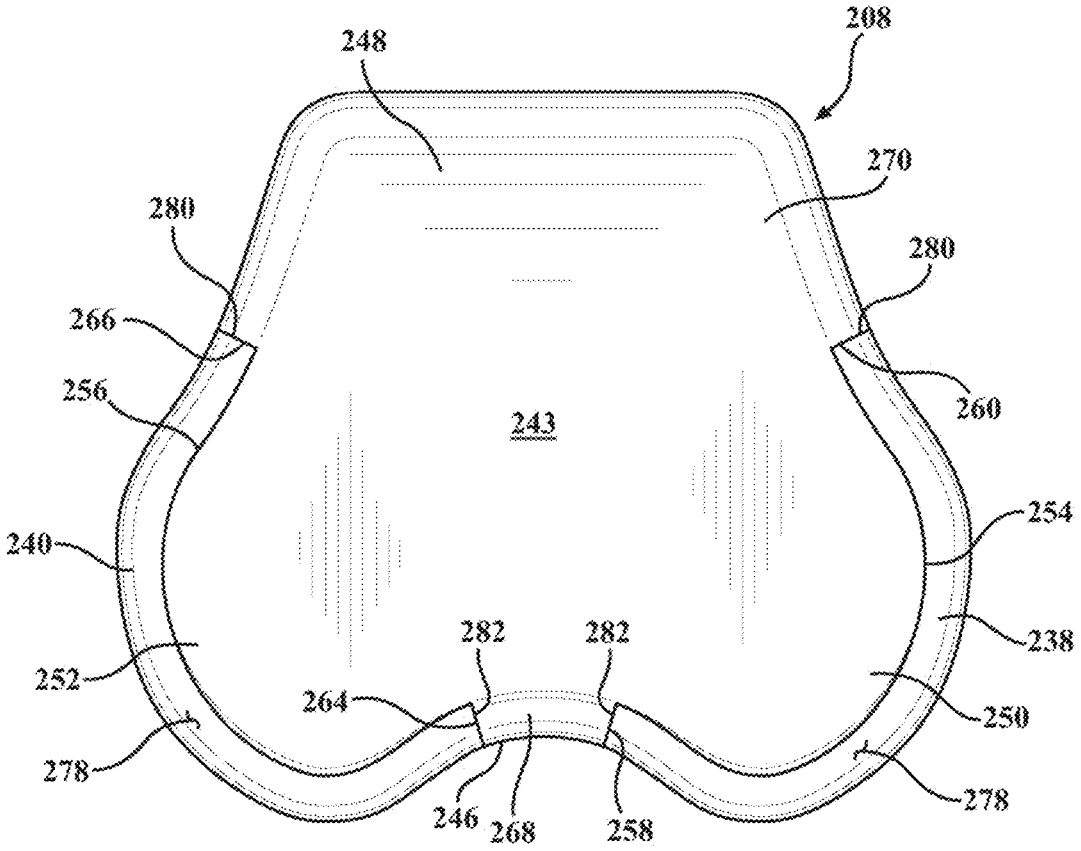
FIG. 7 is a top plan view of the insert of FIG. 6.

Referring to FIGS. 1, 3, 4, 6, and 7, in the illustrated example, the insert 208 is formed as a multi-component structure arranged to provide cushioning in the forefoot region 12 of the sole structure 200. For example, as illustrated in FIGS. 4, 6, and 7, the insert 208 may include a central member 236, a lateral peripheral member 238, and a medial peripheral member 240. The central member 236 and the lateral and medial peripheral members 238, 240 may be assembled and secured to each other using various methods of bonding, including adhesively bonding and melding, for example.

As illustrated in FIGS. 3, 4, 6, and 7, the central member 236 may further include a top surface 243, a bottom surface 244 formed on an opposite side of the central member 236 than the top surface 243, and a peripheral side surface 246 extending between the top surface 243 and the bottom surface 244. The peripheral side surface 246 generally defines an outer periphery of the central member 236. In the assembled configuration, the top surface 243 of the central member 236 may oppose (e.g., engage) the intermediate surface 234 of the primary member 206, while the peripheral side surface 246 may oppose (e.g., engage) the lateral and medial peripheral members 238, 240 or the anterior and posterior peripheral sidewalls 232, 233 that define the recess 226. In some implementations, the peripheral side surface 246 is contoured to match a profile or shape of (i) the intermediate surface 234 or the anterior or posterior peripheral sidewalls 232, 233 of the primary member 206, or (ii) the lateral or medial peripheral members 238, 240. In this regard, as shown in FIGS. 6 and 7, one or more of the top, bottom, and peripheral side surfaces 243, 244, 246 may define the shape of the central member 236 to include a lobed-shape having a plurality of lobes. For example, the central member 236 may include an anterior lobe 248, a lateral posterior lobe 250, and a medial posterior lobe 252, each defined at least in part by one of the surfaces 243, 244, 246. In particular, the anterior lobe 248, the lateral posterior lobe 250, and the medial posterior lobe 252 may each be defined by convex "U"-shaped portions of the peripheral surface 246, such that the central member 236 defines a substantially clover-shaped construct.

As illustrated in FIGS. 2 and 3, the bottom surface 244 of the central member 236 may include a protrusion 253. For example, the protrusion 253 may define a peripheral lip surrounding a portion 244-1 of the bottom surface 244. In some implementations, the portion 244-1 of the bottom surface 244 is concave. As will be explained in more detail below, in an assembled configuration, the portion 244-1 of the bottom surface 244 may be exposed through the outsole 204.

With reference to FIG. 4, the peripheral surface 246 of the central member 236 may further include lateral and medial peripheral grooves 254, 256 extending around a portion of the central member 236. For example, the lateral posterior lobe 250 may include the lateral peripheral groove 254, while the medial posterior lobe 252 may include the medial peripheral groove 256. As illustrated in FIG. 6, the lateral peripheral groove 254 may extend from a first end 258 disposed between a pair of the lobes 248, 250, 252 (e.g., between the lateral and medial posterior lobes 250, 252) to a second end 260 disposed between another pair of the lobes 248, 250, 252 (e.g., between the lateral posterior lobe 250 and the anterior lobe 248). Similarly, the medial peripheral groove 256 may extend from a first end 264 disposed between a pair of the lobes 248, 250, 252 (e.g., between the lateral and medial posterior lobes 250, 252) to a second end 266 disposed between another pair of the lobes 248, 250, 252 (e.g., between the medial posterior lobe 252 and the anterior lobe 248).

As illustrated in FIGS. 6 and 7, the first ends 258, 264 of the lateral and medial peripheral grooves 254, 256, respectively, may be separated by a first outwardly projecting portion 268 of the central member 236, while the second ends 260, 266 of the lateral and medial peripheral grooves 254, 256, respectively, may be separated by a second outwardly projecting portion 270 of the central member 236. For example, at the first and second outwardly projecting portions 268, 270, one or more of the top surface 243, the bottom surface 244, or the peripheral surface 246 may extend outwardly relative to adjacent portions of the top surface 243, the bottom surface 244, or the peripheral surface 246, respectively.

As shown in FIG. 4, a cross-sectional shape of the peripheral grooves 254, 256 may correspond to (e.g., match) an outer cross-sectional shape of the lateral and medial peripheral members 238, 240. In some implementations, the lateral and medial peripheral grooves 254, 256 extend partially from the top surface 243 to the bottom surface 244 of the central member 236 and terminate at lateral and medial intermediate surfaces 272, 274, respectively, disposed between the bottom surface 244 and the top surface 243, such that the central member 236 includes lateral and medial flanges 273, 275 extending outwardly from the peripheral surface 246 and a central portion of the central member 236. The flanges 273, 275 may be defined at least in part by the bottom surface 244 and the intermediate surfaces 272, 274. In this regard, the corresponding peripheral surface 246 may extend through only a portion of a thickness of the central member 236 at the peripheral grooves 254, 256.

Referring to FIGS. 6 and 7, the size, shape, and assembled arrangement of the lateral peripheral member 238 may be substantially similar to the size, shape, and arrangement of the medial peripheral member 240. Accordingly, like reference numerals will be used to describe like features of the lateral and medial peripheral members 238, 240. The peripheral members 238, 240 may each include opposed inner and outer peripheral surfaces 276, 278 and opposed proximal and distal ends 280, 282. The inner and outer peripheral surfaces 276, 278 may extend from the proximal end 280 to the distal end 282. In some implementations, the outer peripheral surface 278 defines a convex profile extending between the proximal and distal ends 280, 282. For example, the profile of the outer peripheral surface 278 may match the profile of the peripheral surface 246 of the central member 236. Similarly, the profile of the inner peripheral surface 276 may match the profile of the peripheral surface 246 at the peripheral grooves 254, 256.

In some implementations, the central member 236 and the lateral and medial peripheral members 238, 240 are each made at least in part of a polymer foam material. For example, the central member 236 may be constructed from a first polymer foam material having a first set of properties (e.g., density, modulus of elasticity, modulus of rigidity, stiffness, etc.), and the lateral or medial peripheral members 238, 240 may be constructed from a second polymer foam material having a second set of properties (e.g., density, modulus of elasticity, modulus of rigidity, stiffness, etc.). The second set of properties may be different than the first set of properties, such that the lateral and medial peripheral members 238, 240 have a different reaction (e.g., flex, shear, compression, etc.) than the central member 236 upon the application of a force on the central member 236 and the lateral and medial peripheral members 238, 240. For example, the lateral and medial peripheral members 238, 240 may have a modulus of rigidity or elasticity that is greater than the modulus of rigidity or elasticity of the central member 236 such that, a force applied on the outer peripheral surface 278 of the peripheral members 238, 240 or the top surface 243 of the central member 236 is attenuated differently by the peripheral members 238, 240 than it is by the central member 236. In particular, the peripheral members 238, 240 may compress less than the central member 236 under an applied load to provide a variable distribution of forces across the insert 208 and active cushioning, stability, and support by attenuating ground-reaction forces during forward running movements of the footwear 10.

Referring to FIG. 6, the peripheral members 238, 240 and/or the central member 236 may further include a material 284 on at least a portion of the outer peripheral surface 278, the top surface 243, and/or the bottom surface 244. In some implementations, the material 284 is applied as a layer on the outer peripheral surface 278 and the bottom surface 244 (e.g., the portion 244-1 of the bottom surface 244). For example, the material 284 may be applied to the outer peripheral surface 278 and the bottom surface 244 using an overmolding, painting, or other suitable process. The material 284 may include or otherwise define a high gloss finish. For example, the material 284 may have a glossiness corresponding to a first gloss unit value that is greater than the glossiness of the lateral and medial peripheral members 238, 240 (e.g., of the surface 278). In some implementations, the material 284 is transparent or translucent such that the lateral and medial peripheral members 238, 240 and/or the central member 236 are visible through the material 284. Alternatively, the material 284 itself may define an opaque, high-gloss finish. In some implementations, the material 284 and the lateral and/or peripheral members 238, 240 may have the same gloss unit value.

Referring to FIGS. 1-4, when the sole structure 200 is assembled, the lateral and medial peripheral members 238, 240 may be disposed within the peripheral grooves 254, 256, respectively, such that the inner peripheral surface 276 of the lateral and medial peripheral members 238, 240 engages the peripheral surface 246 of the central member 236, and the proximal and distal ends 280, 282 engage the corresponding ends 258, 260, 264, 266 defined by the peripheral grooves 254, 256. The insert 208 may be disposed within the recess 226 such that the top surface 243 of the central member 236 engages the intermediate surface 234 of the primary member 206, and the bottom surface 244 of the central member 236 may be flush (e.g., coplanar) with the bottom surface 218 of the central member 236 such that the lateral and medial peripheral members 238, 240 (e.g., the material 284) are exposed or visible within the openings 235 of the primary member 206. In particular, as best illustrated in FIG. 5, the receptacles 242 may receive the components of the insert 208. For example, in the illustrated example, the anterior lobe 248 may be disposed within a first one of the receptacles 242, the lateral posterior lobe 250, including the lateral peripheral member 238, may be disposed within a second one of the receptacles 242, and the medial posterior lobe 252, including the medial peripheral member 240, may be disposed within a third one of the receptacles 242.

As previously described, the peripheral members 238, 240 and the central member 236 may be arranged to provide localized cushioning characteristics to the sole structure 200. As shown in FIG. 2, a longitudinal position of the peripheral members 238, 240 may correspond to the location of the metatarsophalangeal (MTP) joints of the foot at the ball portion $\mathbf{12}_B$ of the forefoot region 12.

Referring to the cross-sectional view of FIGS. 3 and 4, when the sole structure 200 is assembled, the primary member 206 and the insert 208 may cooperate to define a profile of the ground-engaging surface 30. In this regard, the midsole 202 may be referred to as defining the profile of the ground-engaging surface 30, while the outsole 204 actually forms the ground-engaging surface 30. For example, the shape of the ground-engaging surface 30 may be determined by the midsole 202, and the outsole 204 may be overmolded onto the midsole 202 to provide wear resistance and traction properties. In other examples the outsole 204 may be formed separately from the midsole 202 and adhesively bonded to midsole 202. The outsole 204 may form the ground-engaging surface 30 having a profile substantially similar to the profile defined by the cooperation of the various components 206, 208, 210 of the midsole 202. The outsole 204 may be described as having an inner surface 299 configured to attach to the bottom surface 218 of the primary member 206 and the bottom surface 244 of the insert 208. An outer surface 300 of the outsole 204 may be formed on an opposite side from the inner surface 299 and form the ground-engaging surface 30 of the sole structure 200. Accordingly, the outsole 204 at least partially encompasses each of the primary member 206 and the insert 208. As illustrated in FIGS. 2 and 3, in some implementations, the outsole 204 includes an aperture 302. The aperture 302 may extend through one or both of the inner surface 299 and the outer surface 300. In the assembled configuration, the protrusion 253 of the insert 208 may be disposed within the aperture 302 such that the portion 244-1 of the bottom surface 244 is exposed (e.g., visible) through the aperture 302.

With this arrangement, the cushioning and performance properties of the insert 208 are imparted to the ground-engaging surface 30. Particularly, forces associated with pushing off of the forefoot during running or jumping motions may be absorbed by the insert 208. Further, the generally higher modulus of rigidity or elasticity of the lateral and medial peripheral members 238, 240—relative to the modulus of rigidity or elasticity of the central member 236—may provide a relatively local, rigid area at the lateral and medial peripheral members 238, 240 that aid in banking during lateral movements.

Figure 8:
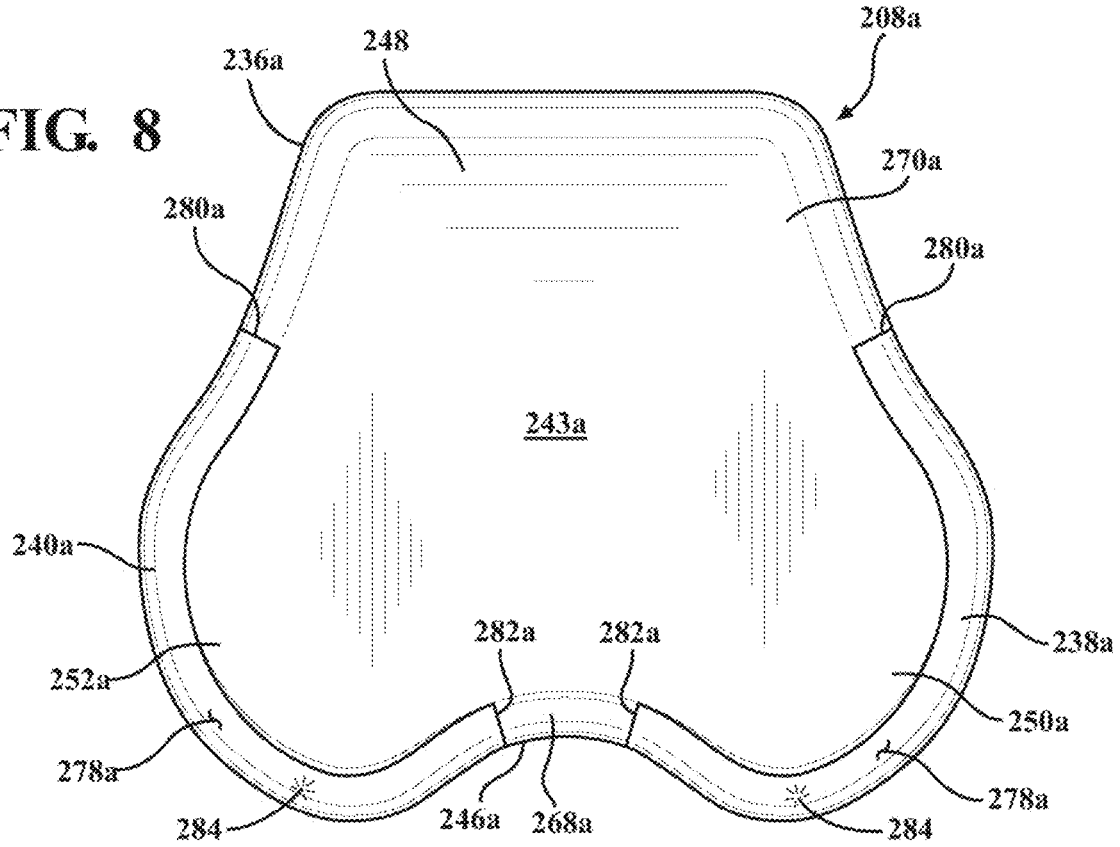
FIG. 8 is a top plan view of another insert for use with the article of footwear of FIG. 1, in accordance with the principles of the present disclosure.
Figure 9:
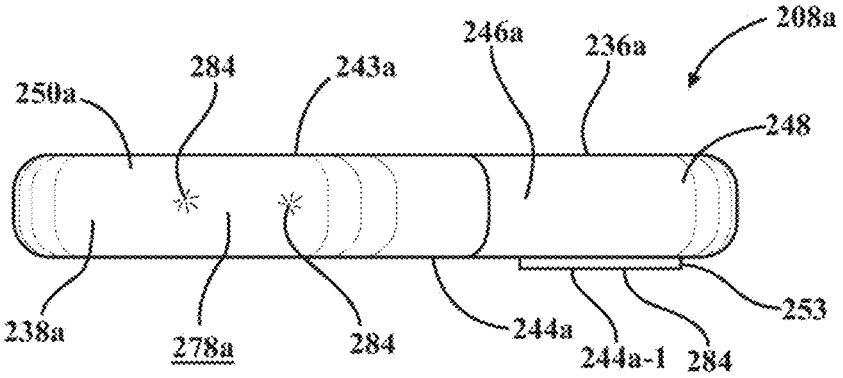
FIG. 9 is a side elevation view of the insert of FIG. 8.
Figure 10:
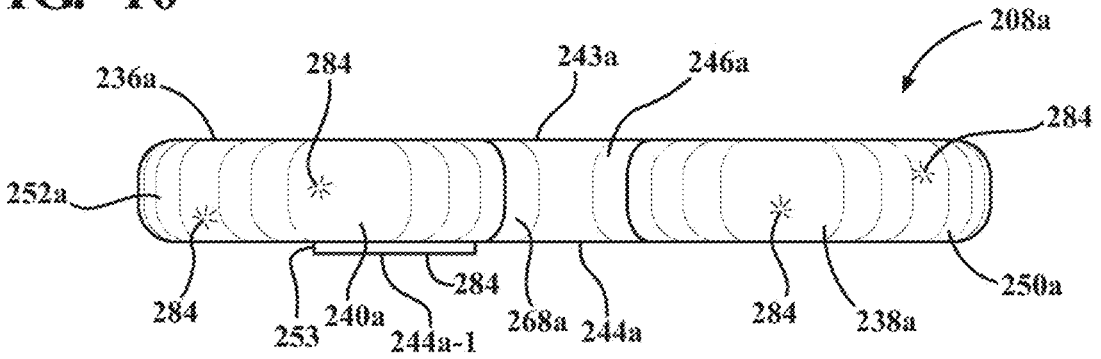
FIG. 10 is a front elevation view of the insert of FIG. 8.

Referring now to FIGS. 8-10, another insert **208*a* for use with the article of footwear 10 is provided. In view of the substantial similarity in structure and function of the insert 208*a* with respect to the insert 208**, like reference numerals are used hereinafter and in the drawings to identify like components while like reference numerals containing letter extensions are used to identify those components that have been modified.

As illustrated, the insert **208*a* may be formed as a unitary structure arranged to provide cushioning in the forefoot region 12 of the sole structure 200. For example, the insert 208*a* may include a central member 236*a*** having a monolithic construct.

With reference to FIG. 8-10, the central member **236*a* may further include a top surface 243*a*, a bottom surface 244*a* formed on an opposite side of the central member 236*a* than the top surface 243*a*, and a peripheral side surface 246*a* extending between the top surface 243*a* and the bottom surface 244*a*. The peripheral side surface 246*a* generally defines an outer periphery of the central member 236*a*. In the assembled configuration, the top surface 243*a* of the central member 236*a* may oppose (e.g., engage) the intermediate surface 234 of the primary member 206, while the peripheral side surface 246*a* may oppose (e.g., engage) the anterior and posterior peripheral sidewalls 232, 233 that define the recess 226. In some implementations, the peripheral side surface 246*a* is contoured to match a profile or shape of the intermediate surface 234 or the anterior or posterior peripheral sidewalls 232, 233 of the primary member 206. In this regard, one or more of the top, bottom, and peripheral side surfaces 243***a*, 244*a*, 246*a* may define the shape of the central member 236*a* to include a lobed-shape having a plurality of lobes. For example, the central member 236*a* may include an anterior lobe 248*a*, a lateral posterior lobe 250*a*, and a medial posterior lobe 252*a*, each defined at least in part by one of the surfaces 243*a*, 244*a*, 246*a*. In particular, the anterior lobe 248*a*, the lateral posterior lobe 250*a*, and the medial posterior lobe 252*a* may each be defined by convex "U"-shaped portions of the peripheral surface 246*a*, such that the central member 236*a* defines a substantially clover-shaped construct.

The insert 208*a* may further include the material 284 disposed on at least a portion of the top surface 243*a*, the bottom surface 244*a*, and the peripheral side surface 246*a*. For example, as illustrated in FIGS. 8-10, the material 284 may be disposed on portions of the peripheral side surface 246*a* proximate the lateral posterior lobe 250*a* and the medial posterior lobe 252*a*. In some implementations, the material 284 is applied as a layer on one or more of the peripheral side surface 246*a*, the top surface 243*a*, and the bottom surface 244*a*. For example, the material 284 may be applied to the peripheral side surface 246*a*, the top surface 243*a*, and/or the bottom surface 244*a* using an overmolding, painting, or other suitable process. In some implementations, the material 284 may include a lateral peripheral portion 238*a* extending between first and second ends 280*a*, 282*a* on the lateral posterior lobe 250*a* and a medial peripheral portion 240*a* extending between first and second ends 280*a*, 282*a* on the medial posterior lobe 252*a*, such that the second ends 282*a* of the lateral and medial peripheral portions 238*a*, 240*a* are separated by a first portion 268*a* of the central member 236*a*, while the first ends 280*a* of the lateral and medial peripheral portions 238*a*, 240*a*, respectively, are separated by a second portion 270*a* of the central member 236*a*. In some implementations, the material 284 is disposed on the bottom surface 244, including on the protrusion 253 and the corresponding portion 244-1 of the bottom surface 244. In other implementations, the material 284 covers the entire outer surface (e.g., the top surface 243*a*, the bottom surface 244, and the peripheral side surface 246*a*) of the central member 236*a*.

As previously described, the material 284 may include or otherwise define a high gloss finish. For example, the material 284 may have a glossiness corresponding to a first gloss unit value that is greater than the glossiness of the central member 236*a* (e.g., of the peripheral side surface 246*a*). In some implementations, the material 284 is transparent or translucent such that portions (e.g., the lateral and medial peripheral portions 238*a*, 240*a*) of the central member 236*a* covered by the material 284 are visible through the material 284. Alternatively, the material 284 itself may define an opaque, high-gloss finish. In other implementations, the material 284 and the lateral and/or medial peripheral portions 238*a*, 240*a* may have the same gloss unit value.

In some implementations, the central member 236*a* is made at least in part of a polymer foam material. For example, the central member 236*a* may be constructed from a first polymer foam material having a first set of properties (e.g., density, modulus of elasticity, modulus of rigidity, stiffness, etc.) similar to the central member 236.

Referring to FIGS. 1, 5 and 8, when the sole structure 200 is assembled, the insert 208*a* may be disposed within the recess 226 such that the top surface 243*a* of the central member 236*a* engages the intermediate surface 234 of the primary member 206 and the lateral and medial peripheral portions 238*a*, 240*a* (e.g., the material 284) are exposed or visible within the openings 235 of the primary member 206. In particular, as best illustrated in FIG. 5, the receptacles 242 may receive the components of the insert 208*a*. For example, in the illustrated example, the anterior lobe 248*a* may be disposed within a first one of the receptacles 242, the lateral posterior lobe 250*a*, including the lateral peripheral portion 238*a*, may be disposed within a second one of the receptacles 242, and the medial posterior lobe 252*a*, including the medial peripheral portion 240*a*, may be disposed within a third one of the receptacles 242. The inner surface 299 of the outsole 204 may be attached to the bottom surface 218 of the primary member 206 and the bottom surface 244*a* of the insert 208*a*. An outer surface 300 of the outsole 204 may be formed on an opposite side from the inner surface 299 and form the ground-engaging surface 30 of the sole structure 200. Accordingly, the outsole 204 may at least partially encompass each of the primary member 206 and the insert 208*a*. As previously described, and as illustrated in FIG. 2, the protrusion 253 of the insert 208*a* may be disposed within the aperture 302 of the outsole 204 such that the portion 244*a*-1 of the bottom surface 244*a* is exposed (e.g., visible) through the aperture 302.

As previously described, the peripheral portions 238*a*, 240*a* and the central member 236*a* may be arranged to provide localized cushioning characteristics to the sole structure 200. For example, a longitudinal position of the peripheral portions 238*a*, 240*a* may correspond to the location of the metatarsophalangeal (MTP) joints of the foot at the ball portion $\mathbf{12}_B$ of the forefoot region 12.

The following Clauses provide an exemplary configuration for a sole structure for an article of footwear described above.

Clause 1: A sole structure for an article of footwear, the sole structure comprising a midsole having a top surface, a bottom surface opposite the top surface, and a peripheral surface extending between the top surface and the bottom surface, the bottom surface including a recess defining a first opening in the peripheral surface and an insert disposed within the recess and including a first material having a first gloss unit value and a second material disposed on an outer surface of the first material and having a second gloss unit value, the second material at least partially disposed within the first opening.

Clause 2: The sole structure of Clause 1, wherein the first material is visible through the second material.

Clause 3: The sole structure of Clause 1, wherein the first opening is disposed in a medial side of the midsole.

Clause 4: The sole structure of Clause 1, wherein the recess defines a second opening in the peripheral surface, and wherein the second material is at least partially disposed within the second opening.

Clause 5: The sole structure of Clause 4, wherein the first opening is disposed in a medial side of the midsole, and wherein the second opening is disposed in a lateral side of the midsole opposite the medial side.

Clause 6: The sole structure of Clause 1, further comprising an outsole coupled to at least one of the midsole or the insert and defining an aperture, wherein the second material is at least partially disposed within the aperture.

Clause 7: The sole structure of Clause 6, wherein the insert includes a protrusion disposed within the aperture.

Clause 8: The sole structure of Clause 7, wherein the second material is disposed on the protrusion.

Clause 9: The sole structure of Clause 1, wherein the insert includes a central member and a peripheral member, the peripheral member at least partially disposed within the first opening.

Clause 10: The sole structure of Clause 9, wherein the second material is disposed on the peripheral member.

Clause 11: The sole structure of Clause 1, wherein the second gloss unit value is greater than the first gloss unit value.

Clause 12: A sole structure for an article of footwear, the sole structure comprising a midsole having a top surface, a bottom surface opposite the top surface, and a peripheral surface extending between the top surface and the bottom surface, the midsole including a recess (i) disposed between the top surface and the bottom surface and (ii) defining a first opening in the peripheral surface and an insert disposed within the recess and including a first material having a first gloss unit value and a second material disposed on an outer surface of the first material and having a second gloss unit value, the second material at least partially disposed within the first opening.

Clause 13: The sole structure of Clause 12, wherein the first material is visible through the second material.

Clause 14: The sole structure of Clause 12, wherein the first opening is disposed in a medial side of the midsole.

Clause 15: The sole structure of Clause 12, wherein the recess defines a second opening in the peripheral surface, and wherein the second material is at least partially disposed within the second opening.

Clause 16: The sole structure of Clause 15, wherein the first opening is disposed in a medial side of the midsole, and wherein the second opening is disposed in a lateral side of the midsole opposite the medial side.

Clause 17: The sole structure of Clause 12, further comprising an outsole coupled to at least one of the midsole or the insert and defining an aperture, wherein the second material is at least partially disposed within the aperture.

Clause 18: The sole structure of Clause 17, wherein the insert includes a protrusion disposed within the aperture.

Clause 19: The sole structure of Clause 18, wherein the second material is disposed on the protrusion.

Clause 20: The sole structure of Clause 12, wherein the insert includes a central member and a peripheral member, the peripheral member at least partially disposed within the first opening.

Clause 21: The sole structure of Clause 20, wherein the second material is disposed on the peripheral member.

Clause 22: The sole structure of Clause 12, wherein the second gloss unit value is greater than the first gloss unit value.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a midsole having a top surface, a bottom surface opposite the top surface, and a peripheral surface (i) extending between the top surface and the bottom surface and (ii) defining a first opening at a medial side of the sole structure and a second opening at a lateral side of the sole structure, the first opening and the second opening disposed in a forefoot region of the sole structure;

a first cushion having a first arcuate outer surface that is visible at the medial side via the first opening, the first arcuate outer surface including a first gloss unit value that is higher than a gloss unit value of the peripheral surface; and a second cushion having a second arcuate outer surface that is visible at the lateral side via the second opening, the second arcuate outer surface including a second gloss unit value that is higher than the gloss unit value of the peripheral surface.

2. The sole structure of claim 1, wherein the first cushion is aligned with the second cushion across a width of the sole structure.

3. The sole structure of claim 1, wherein the first arcuate outer surface and the second arcuate outer surface each forms an outer surface of the sole structure.

4. The sole structure of claim 1, further comprising an outsole having an upper surface opposing the midsole and a second surface formed on an opposite side of the outsole than the upper surface and defining a ground-contacting surface of the sole structure.

5. The sole structure of claim 4, further comprising a gap defined between the bottom surface of the midsole and the upper surface of the outsole, the first cushion and the second cushion disposed within the gap and attached on a first side to the bottom surface of the midsole and on a second side, opposite the first side, to the upper surface of the outsole.

6. The sole structure of claim 1, wherein the first cushion is formed separately from the midsole.

7. The sole structure of claim 6, wherein the second cushion is formed separately from the midsole.

8. The sole structure of claim 1, further comprising a coating applied to the first arcuate outer surface and the second arcuate outer surface.

9. The sole structure of claim 8, wherein the coating provides the first arcuate outer surface with the first gloss unit value and provides the second arcuate outer surface with the second gloss unit value.

10. An article of footwear incorporating the sole structure of claim 1.

11. A sole structure for an article of footwear, the sole structure comprising:

a midsole having a top surface, a bottom surface opposite the top surface, and a peripheral surface (i) extending between the top surface and the bottom surface and (ii) defining a first opening at a medial side of the sole structure and a second opening at a lateral side of the sole structure, the first opening and the second opening disposed in a forefoot region of the sole structure;

an outsole including an upper surface and a ground-contacting surface formed on an opposite side of the outsole than the upper surface;

a gap defined between the bottom surface of the midsole and the upper surface of the outsole in the forefoot region;

a first cushion disposed within the gap and having a first arcuate outer surface that is visible at the medial side via the first opening and includes a first gloss unit value that is higher than a gloss unit value of the peripheral surface; and a second cushion disposed within the gap and having a second arcuate outer surface that is visible at the lateral side via the second opening and includes a second gloss unit value that is higher than the gloss unit value of the peripheral surface.

12. The sole structure of claim 11, wherein the first cushion is aligned with the second cushion across a width of the sole structure.

13. The sole structure of claim 11, wherein the first arcuate outer surface and the second arcuate outer surface each forms an outer surface of the sole structure.

14. The sole structure of claim 11, wherein the first cushion is formed separately from the midsole.

15. The sole structure of claim 14, wherein the second cushion is formed separately from the midsole.

16. The sole structure of claim 11, wherein the midsole is formed from a foam material.

17. The sole structure of claim 11, further comprising a first peripheral member attached to the first cushion and a second peripheral member attached to the second cushion, the first peripheral member and the second peripheral member respectively providing the first arcuate outer surface with the first gloss unit value and the second arcuate outer surface with the second gloss unit value.

18. The sole structure of claim 11, further comprising a coating applied to the first arcuate outer surface and the second arcuate outer surface.

19. The sole structure of claim 18, wherein the coating provides the first arcuate outer surface with the first gloss unit value and provides the second arcuate outer surface with the second gloss unit value.

20. An article of footwear incorporating the sole structure of claim 11.

* * * * *